United States Patent [19]

Izuta

[11] 4,378,780

[45] Apr. 5, 1983

[54] ARROW REST FOR ARCHERY BOW

[75] Inventor: Tadao Izuta, Hamamatsu, Japan

[73] Assignee: Nippon Gakki Seizo Kabushiki Kaisha, Japan

[21] Appl. No.: 961,248

[22] Filed: Nov. 16, 1978

Related U.S. Application Data

[63] Continuation of Ser. No. 768,860, Feb. 15, 1977, abandoned.

[30] Foreign Application Priority Data

Feb. 24, 1976 [JP] Japan ..... 51/21011

[51] Int. Cl.[3] ..... F41B 5/00

[52] U.S. Cl. ..... 124/24 R; 124/41 A

[58] Field of Search ..... 124/41 A, 24 R, 88, 124/86, 90

[56] References Cited

U.S. PATENT DOCUMENTS 3,285,237 11/1966 Wolfe ..... 124/41 A 3,865,096 2/1975 Troncoso ..... 124/24 R

OTHER PUBLICATIONS

"Match-1" —Archery Magazine, p. 45, May 1974.

*Primary Examiner*—Richard C. Pinkham

*Assistant Examiner*—William R. Browne

*Attorney, Agent, or Firm*—Ostrolenk, Faber, Gerb & Soffen

[57] ABSTRACT

Arrow rest for archery bow is disclosed. The arrow rest is supported at a position remote from the sight window defining wall of the bow and extends obliquely towards the back of the bow with the free end thereof being located close to the sight window defining wall. Bias of the arrow from the correct advancing course at release is effectively restrained and resistance of the arrow rest acting on the arrow at release is greatly minimized, thereby assuring stable and smooth release of the arrow.

4 Claims, 11 Drawing Figures

ARROW REST FOR ARCHERY BOW

RELATED APPLICATIONS

This is a continuation of U.S. patent application Ser. No. 768,860, filed Feb. 15, 1977, now abandoned.

BACKGROUND OF THE INVENTION

The present invention relates to an improved arrow rest for archery bow, and more particularly relates to an improved structure for providing an arrow rest for an archery bow.

In a conventional arrow rest, the arrow rest is fixed at one end to the sight window of the bow and extends longitudinally towards the back of the bow while gradually tapering away from the sight window. As a result of this construction, the fletching of the advancing arrow brushes against the arrow rest as it leaves the bow, forcing the nock of the arrow away from the sight window and throwing the arrow off course. In addition, since the fletching contacts the prior art arrow rest at a position close to the fixed end of the arrow rest, the arrow rest provides a relatively large resistance to the advance of the arrow.

OBJECTS OF THE INVENTION

The principal object of the present invention is to provide an improved arrow rest supporting structure which will prevent an arrow from being biased from a correct course upon release of the bowstring.

Another object of the present invention is to provide an improved arrow rest supporting structure capable of minimizing resistance acting on an arrow at release.

BRIEF DESCRIPTION OF THE INVENTION

In accordance with the present invention, a tongue-shaped elongated body extends across the flight path of the arrow shaft with its free end located close to the sight window of the bow. Means are provided for supporting the elongated body at a position remote from the sight window portion and the elongated body is capable of returning to its original resting position after being contacted by the arrow.

In one preferred embodiment of the present invention, the elongated body is made of an elastic material.

In the other preferred embodiment of the present invention, the elongated body is supported for pivotal movement in a plane paralled to the surface of the shoulder portion of the bow and the supporting means include means for elastically returning the elongated body to the original position after being hit by the arrow.

DETAILED DESCRIPTION OF THE INVENTION

Figure 1:
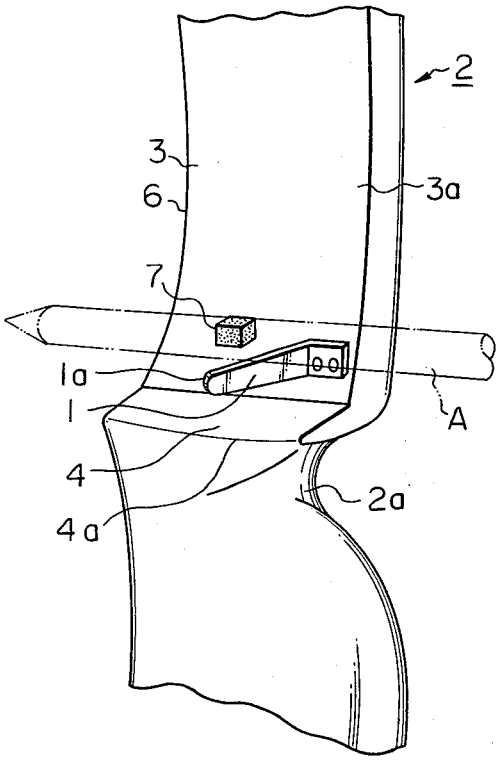
Fig. 1 PRIOR ART
FIG. 1 is a perspective view of the conventional arrow rest and its related parts of the bow.
Figure 3:
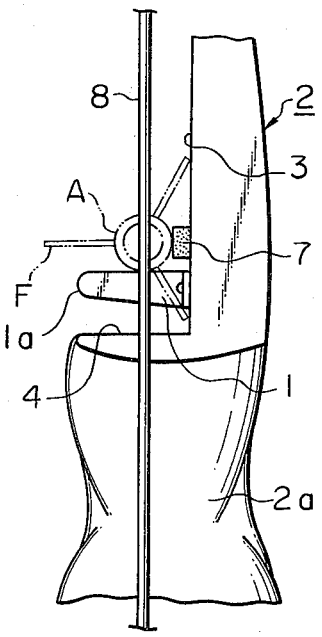
Fig. 3 PRIOR ART
FIG. 3 is a view seen from the bow string side of the arrangement shown in FIG. 1.
Figure 2:
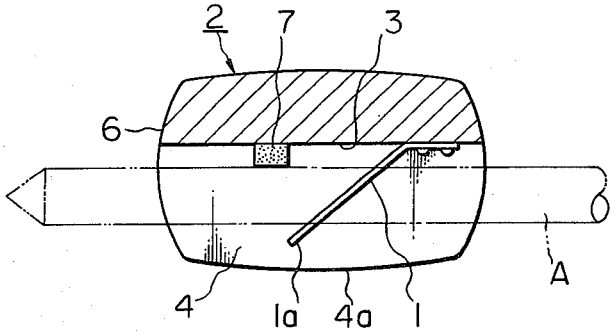
Fig. 2 PRIOR ART
FIG. 2 is a top view, partly in section, of the arrangement shown in FIG. 1.

A typical arrangement of the conventional arrow rest and the related parts of a bow is illustrated in FIGS. 1 through 3, in which one end of a tongue-shaped arrow rest 1 is fixed to one end of a generally vertical sight window wall 3 (i.e. the wall of the bow handle section 2 defining the sight window 3*a*) at a position slightly above the generally horizontal shoulder portion 4. The arrow rest 1 extends longitudinally in a direction oblique to the sight window wall 3 towards the front 6 of the bow while gradually tapering away from the sight window wall 3. The free end 1*a* of the arrow rest 1 is positioned near the fringe 4*a* of the shoulder portion 4. The arrow rest 1 is made of a material capable of elastically resuming its original shape and posture after deformation. A pad 7, or a plunger, is also attached to the sight window wall 3 at a position somewhat closer to the back 6 of the bow than the arrow rest 1. Pad 7 comes in contact with the shaft A of the arrow when the shaft A rests on the arrow rest 1 as shown in phantom in FIG. 1.

The behaviour of shaft A at the moment of release is shown in sequence in FIGS. 4A through 4D.

Figure 4A:
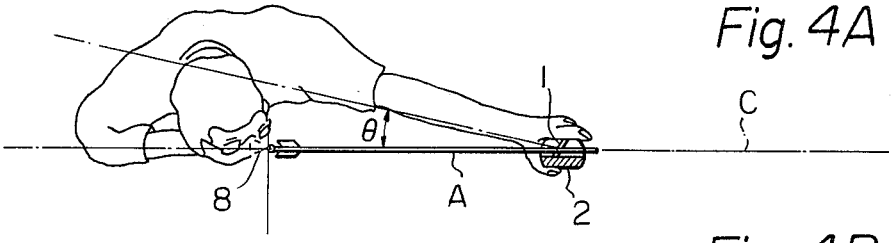
FIGS. 4A through 4D are explanatory top views for showing the behaviour of an arrow at release.

In the stage shown in FIG. 4A, the hand gripping portion 2*a* of the bow is gripped by the bow hand of the archer and, when the bow string 8 is drawn, the nock of shaft A is held, together with the bow string 8, by the drawing hand of the archer.

Figure 4B:
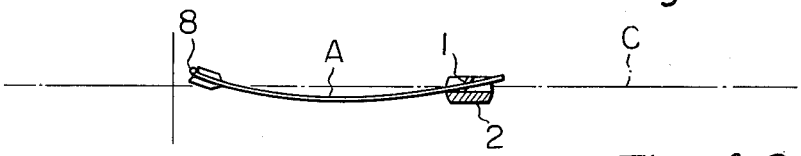
Figure 4C:
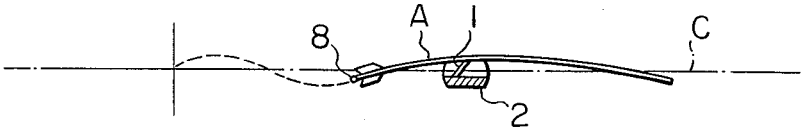
Figure 4D:
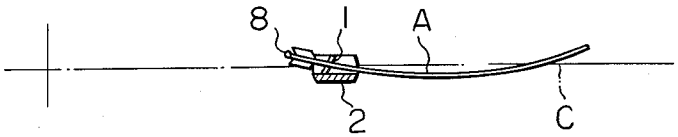

The archer's bow supporting arm forms an angle $\theta$ with the shaft A of the arrow. As a result of this angle, and the frictional resistance between the fingers of drawing hand and the bow string 8, a torque is generated at the nock of the shaft A, causing shaft A to flex convexly with respect to the handle section 2 of the bow just after release as shown in FIG. 4B. As the arrow advances, the shaft A flexes concavely with respect to the handle section 2 of the bow as shown in FIG. 4C. As the fletchings F of the arrow approach the arrow rest 1, the shaft A again flexes convexly with respect to the handle section 2 as shown in FIG. 4D. The above-described behaviour of the arrow at the time of release is well known and called "archery paradox".

As already described, one end of the conventional arrow rest 1 is fixed to the sight window wall 3 and extends longitudinally towards the back of the bow while gradually tapering away from the sight window wall 3. This causes at least one of the fletchings F to contact the arrow rest 1 as the arrow leaves the bow. See FIG. 3. As a result, the nock end portion of the shaft A is automatically pushed away from the sight window wall 3, knocking the arrow off course.

Figure 5:
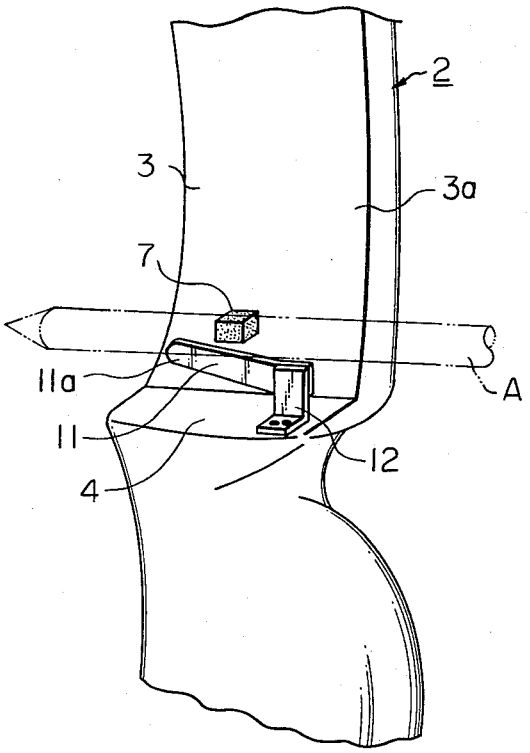
FIG. 5 is a perspective view of one embodiment of the arrow rest in accordance with the present invention and its related parts of the bow.
Figure 7:
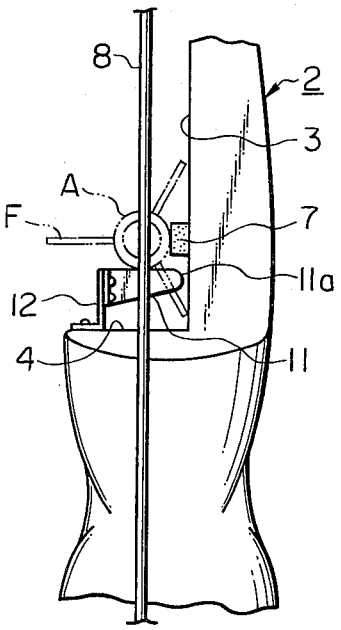
FIG. 7 is a view seen from the bow string side of the arrangement shown in FIG. 1.
Figure 6:
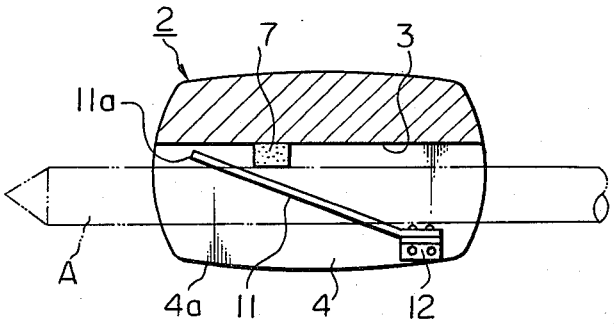
FIG. 6 is a top view, partly in section, of the arrangement shown in FIG. 1.

An embodiment of the arrow rest in accordance with the present invention and its related parts of the bow are shown in FIGS. 5 through 7 (and second and third embodiments in FIGS. 8 and 9), in which elements common to those in the arrangement shown in FIGS. 1 through 3 are designated with same reference symbols.

One end of a tongue-shaped arrow rest 11 is supported on a stand 12 which is attached to the shoulder portion 4 of the sight window 3*a* at a position adjacent fringe 4*a* and remote from the sight window wall 3. The arrow rest 11 extends longitudinally in a direction oblique to the surface of the sight window wall 3 towards the back 6 of the bow while gradually tapering towards the wall 3. The free end 11*a* of the arrow rest 11 is thus positioned close to the sight window wall 3.

In the illustrated embodiment, the arrow rest 11 is securely coupled to the stand 12 and is made of a material such as rubber or plastic which is capable of elastically resuming its original shape and posture after deformation. Alternatively, the arrow rest 11 may be pivotally connected to the stand 12. In such a case, the arrow rest 11 may be made of an elongated rigid body such as a metallic plate or a wire. In the latter case, the pivot shaft 12' extends substantially perpendicularly to the surface of the shoulder portion 4 and a suitable biasing mechanism (such as a spring 13) is annexed to the pivot shaft so that it elastically holds the arrow rest 11' in its original rest position. See FIG. 9.

When any one of the fletchings F of the arrow contacts the arrow rest 11 of the present invention (see FIG. 7), the nock end portion of the shaft A is biased towards the sight window wall 3. As a result, the tendency of the shaft A to move away from sight window wall 3 is restrained and the arrow advances in the desired direction.

Since the arrow rest 11 is either flexible or is pivotally connected to stand 12, it is permitted to move away from wall 3 when contacted by the fletching. As a result, the resistance of the arrow against the arrow rest is greatly minimized and a stable release of the arrow assured.

In accordance with the present invention, the supporting point of the arrow rest 11 is located on the shoulder portion 4 of the bow. By so locating the supporting point of the arrow rest 11 as close as possible to the fringe 4*a* of the shoulder portion, it is possible to maximize the distance between the supporting point and the resting point of the shaft A on the arrow rest. As a result, the fletching F of the arrow contacts the arrow rest 11 near the free end of the arrow rest where the resistance of the arrow rest to the smooth advancement of the arrow sis a minimum.

Figure 8:
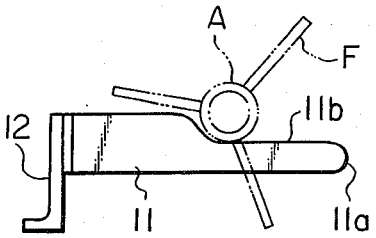
FIG. 8 is a side view of a modified embodiment of the arrow rest in accordance with the present invention.
Figure 9:
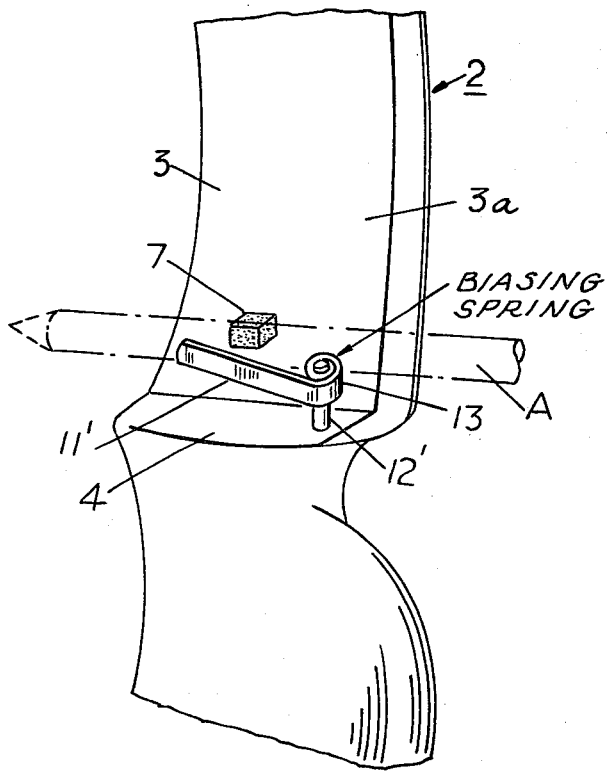

A modification of the arrow rest in accordance with the present invention is shown in FIG. 8. In this embodiment, a scooped portion 11*b* is formed in the upper side of the arrow rest 11 at a position near its free end 11*a*. The scooped portion 11*b* effectively reduces the possibility that the arrow will move towards the supporting stand 12, and away from the sight window wall 3. In addition, presence of the step formed by the scooped portion 11*b* aids the beginner by preventing the arrow from falling off of the arrow rest.

I claim:

1. An archery bow for use with an arrow of the type which includes a cylindrical shaft having a nock formed on one end thereof and a plurality of fletchings spaced 120° apart about the periphery of said shaft, said archery bow comprising:

(a) an archery bow having a sight window formed therein, said sight window including a generally horizontal bottom wall and a generally vertical side wall; and (b) an improved arrow rest, comprising:

(1) an elongated body having a free end and being flexible in a direction parallel to said generally horizontal bottom wall;

(2) support means coupled to said elongated body at a point spaced from said free end; said support means supporting said elongated body along a line extending between a first point and a second point forward of, and closer to said side wall than, said first point; said second point defining said free end of said elongated body and being sufficiently close to said side wall to ensure that when said arrow is shot by said bow with a first one of said fletchings oriented substantially perpendicular to said side wall and the remaining said fletchings contacting said side wall, a second fletching of said arrow contacts said elongated body and is biased, along with said nock, towards said side wall by the combined effect of said elongated body and said support means; said elongated body having a scooped portion therein extending from said free end towards the other end of said elongated body, said scoop portion limiting the distance which said arrow shot by said bow can move away from said generally vertical side wall.

2. An archery bow for use with an arrow of the type which includes a cylindrical shaft having a nock formed on one end thereof and a plurality of fletchings spaced 120° apart about the periphery of said shaft, said archery bow comprising:

(a) an archery bow having a sight window formed therein, said sight window including a generally horizontal bottom wall and a generally vertical side wall; and (b) an improved arrow rest, comprising:

(1) a flexible elongated body having a free end; and (2) support means coupled to said elongated body at a point spaced from said free end; said support means for supporting said elongated body along a line extending between a first point and a second point forward of, and closer to said side wall than, said first point; said support means and said elongated body cooperating to bias said elongated body towards said side wall but permitting movement of said body away from said side wall in response to the application of an external force on said body; said second point defining said free end of said elongated body and being sufficiently close to said side wall to ensure that when said arrow is shot by said bow with a first one of said fletchings oriented substantially perpendicular to said side wall and the remaining said fletchings contacting said side wall, one of said remaining fletchings of said arrow contacts said elongated body and is biased, along with said nock, towards said side wall by the combined effect of said elongated body and said support means; said elongated body having a scooped portion extending from said free end towards the other end of said elongated body, said scooped portion limiting the distance which said arrow shot by said bow can move away from said generally vertical side wall when said arrow is shot by said bow.

3. An archery bow for use with an arrow of the type which includes a cylindrical shaft having a nock formed on one end thereof and a plurality of fletchings spaced 120° apart about the periphery of said shaft, said archery bow comprising:

(a) an archery bow having a sight window formed therein, said sight window including a generally horizontal bottom wall and a generally vertical side wall; and (b) an arrow rest coupled to said bow body, said arrow rest comprising:

(1) an elongated body having a free end;

(2) support means coupled to said elongated body at a point spaced from said free end; said support means supporting said elongated body along a line extending between a first point and a second point forward of and closer to said side wall than, said first point; said second point defining said free end of said elongated body and being sufficiently close to said side wall to ensure that when said arrow is shot by said bow with a first one of said fletchings oriented substantially perpendicular to said side wall and the remaining said fletchings contacting said side wall, a second fletching of said arrow contacts said elongated body and is biased, along with said nock, towards said side wall by the combined effect of said elongated body and said support means; said elongated body having a scooped portion therein extending from said free end towards the other end of said elongated body, said scooped portion limiting the distance which said arrow can move away from said generally vertical side wall when said arrow is shot by said bow.

4. A combination comprising:

(a) an arrow of the type which includes a cylindrical shaft having a nock formed on one end thereof and a plurality of fletchings spaced 120° apart about the periphery of said shaft;

(b) an archery bow comprising a bow body and an arrow rest coupled to said bow body, said bow body having a sight window formed therein, said sight window including a generally horizontal bottom wall and a generally vertical side wall; and (c) said arrow rest comprising:

(1) an elongated body having a free end;

(2) support means coupled to said elongated body at a point spaced from said free end; said support means supporting said elongated body along a line extending between a first point and a second point forward of, and closer to said side wall than, said first point; said second point defining said free end of said elongated body and being sufficiently close to said side wall to ensure that when said arrow is shot by said bow with one of said plurality of fletchings oriented substantially perpendicular to said side wall and the remaining other fletchings of said plurality of fletchings contacting said side wall, one of the remaining other fletchings of said arrow contacts said elongated body and is biased, along with said nock, towards said side wall by the combined effect of said elongated body by said support means; said elongated body having a scooped portion therein extending from said free end towards the other end of said elongated body, said scooped portion limiting the distance said arrow can move away from said generally vertical side wall when said arrow was shot by said bow.

* * * * *